US006527136B1

(12) United States Patent
Sabounjian

(10) Patent No.: US 6,527,136 B1
(45) Date of Patent: Mar. 4, 2003

(54) COLLAPSIBLE HAMPER & HANDLE

(75) Inventor: Azad Sabounjian, Aneheim Hills, CA (US)

(73) Assignee: Pro-Mart Industries, Inc., Rancho Cucamonga, CA (US)

( * ) Notice: Subject to any disclaimer, the term of this patent is extended or adjusted under 35 U.S.C. 154(b) by 76 days.

(21) Appl. No.: 09/728,828

(22) Filed: Nov. 22, 2000

(51) Int. Cl.[7] ..... B65D 33/06
(52) U.S. Cl. ..... 220/9.2
(58) Field of Search ..... 220/754, 769, 220/770, 9.1, 9.2, 9.3, 9.4; 383/6

(56) References Cited

U.S. PATENT DOCUMENTS

| | | | | |
|---|---|---|---|---|
| 216,227 | A | 6/1879 | Sedgwick | |
| 356,301 | A | 1/1887 | Belknap | |
| 615,720 | A | * 12/1898 | Lane | 211/1 |
| 1,180,574 | A | 4/1916 | Despot | |
| 1,581,888 | A | 4/1926 | Thomas | |
| 1,583,083 | A | 5/1926 | Macaraig | |
| 1,691,904 | A | 11/1928 | Gamble | |
| 1,979,978 | A | 11/1934 | Martin | 190/58 |
| 1,994,235 | A | 3/1935 | Solomon | 150/1.6 |
| 1,999,424 | A | 4/1935 | Sietz | 190/50 |
| 2,030,204 | A | * 2/1936 | Gray | 220/9.2 |
| 2,182,932 | A | 12/1939 | Sanford | 206/44 |
| 2,269,574 | A | 1/1942 | Benenfeld | 190/54 |
| 2,298,786 | A | 10/1942 | Dubofsky et al. | 190/54 |
| 2,575,893 | A | 11/1951 | Seaman | 150/2.1 |
| 2,710,084 | A | 6/1955 | Braverman | 190/43 |
| 2,746,582 | A | 5/1956 | Cart | 190/58 |
| 2,778,560 | A | 1/1957 | Pfeiffer | 229/41 |
| 2,874,813 | A | * 2/1959 | Bunte | 190/107 |
| 3,373,925 | A | 3/1968 | Gatward | 229/54 |
| 3,696,850 | A | 10/1972 | Rosenblum | 150/33 |
| 3,834,528 | A | 9/1974 | Pickford et al. | 206/526 |
| 3,935,958 | A | 2/1976 | Franges | 220/19 |
| 3,960,161 | A | 6/1976 | Norman | 135/1 |
| 4,055,239 | A | 10/1977 | Weiner | 190/50 |
| 4,646,802 | A | 3/1987 | Basore et al. | 150/49 |
| D290,538 | S | 6/1987 | Basore | D32/37 |
| 4,783,031 | A | 11/1988 | Ebentheuer | 248/97 |
| 4,813,520 | A | 3/1989 | Lin | 190/107 |
| 4,815,784 | A | 3/1989 | Zheng | 296/97.7 |
| 4,930,903 | A | 6/1990 | Mahoney | 939/6 |
| 4,953,815 | A | 9/1990 | Beymer et al. | 248/97 |
| 4,989,749 | A | 2/1991 | Choi | 220/401 |
| 5,022,767 | A | 6/1991 | Cardulla | 383/33 |
| 5,088,838 | A | * 2/1992 | Yeh | 220/754 |
| RE33,842 | E | 3/1992 | Ebentheuer | 248/97 |
| 5,116,138 | A | 5/1992 | Macsenti et al. | 383/33 |
| 5,118,201 | A | 6/1992 | Cook | 383/12 |
| 5,213,147 | A | 5/1993 | Zheng | 160/370 |
| 5,263,672 | A | 11/1993 | He | 248/97 |
| 5,273,142 | A | 12/1993 | Weber | 190/107 |

(List continued on next page.)

FOREIGN PATENT DOCUMENTS

WO PCT/US97/17179 5/1998

*Primary Examiner*—Stephen Castellano
(74) *Attorney, Agent, or Firm*—Stetina Brunda Garred & Brucker

(57) ABSTRACT

A collapsible container is used to carry items. The container has a plurality of flexible frames contained in pockets with material connecting the pockets to define panels when the frames are in an expanded configuration. The frames are adapted to twist and fold into overlapping loops to define a smaller, collapsed configuration. The pockets on the top sides of the panels have openings, with the frames extending across the openings. The openings are sized to allow a person's hand to enter the opening and grip the frame to lift the container during use of the container to carry things. Alternatively, the openings are sized smaller than the width of a flexible strap that encircles the frame in the opening so a person can lift the container with the strap.

32 Claims, 3 Drawing Sheets

U.S. PATENT DOCUMENTS

| | | | | |
|---|---|---|---|---|
| 5,301,705 | A | 4/1994 | Zheng | 135/104 |
| 5,439,017 | A | 8/1995 | Brown | 135/126 |
| 5,618,246 | A | 4/1997 | Zheng | 482/35 |
| 5,800,067 | A | 9/1998 | Easter | 383/104 |
| 5,845,697 | A | 12/1998 | Zheng | 160/370.21 |
| D406,423 | S | 3/1999 | Kellogg et al. | D32/37 |
| 5,964,533 | A | 10/1999 | Ziglar | 383/36 |
| 5,971,188 | A | 10/1999 | Kellogg et al. | 220/9.2 |
| D419,302 | S | 1/2000 | Hardy et al. | D3/306 |
| 6,030,300 | A | 2/2000 | Zheng | 473/471 |
| 6,059,912 | A | 5/2000 | Kellogg et al. | 156/217 |
| 6,073,643 | A | 6/2000 | Zheng | 135/125 |

* cited by examiner

COLLAPSIBLE HAMPER & HANDLE

BACKGROUND

Collapsible containers are known that have four rectangular sides, a bottom and open top. Twist-and-fold frames are contained in pockets around the periphery of each side panel so that opposing sides can be folded against each other, and then the flexible frames twisted into two or three overlapping loops or circles to form a collapsible hamper. The flexible frames contained in pockets are also used to make containers with curved sides. Such collapsible containers are shown and described in U.S. Pat. Nos. 5,971,188 and 5,964,533, the complete contents of which are incorporated herein by reference.

The frames must be of relatively small cross-section in order to allow the twisting-and-folding of the frame into small, portable packages. The flexible structures are also used for collapsible containers used to carry items. But when items are placed in the containers, the container must be lifted carefully, as the flexible nature of the container can make it difficult to hold. The small size of the frames coupled with enclosing the frames in pockets makes it difficult to pick up these containers by grabbing the frames directly. Handles have been provided with the containers, but they are attached to the fabric forming the top or the side panels and that fabric is thin and of insufficient strength to provide for a durable connection. There is thus a need for an improved way to allow a person to grip and lift these collapsible containers.

SUMMARY OF THE INVENTION

A collapsible container is provided to allow a person to manually carry items within the container. At least one handle is connected to the container. The container is of the type having a plurality of flexible frames contained in pockets fastened to flexible material connected to form sides of the container in an expanded configuration. The container can be collapsible into a smaller configuration by twisting and folding the frames into overlapping loops. The handle comprises a flexible handle suitable for manually lifting the container and having a first end extending through an opening in the pocket and encircling a portion of one of the frames within that opening. The first end is connected to the handle. Preferably, a second end of the handle extends through a second opening in the pocket and encircles a portion of the frame within that second opening. The second end is also connected to the handle. This provides an improved handle connection for the flexible frame. A protective sheath can be inserted between the frame and the handle to avoid damaging the handle.

Advantageously, the container has a second handle like the first handle, but located on a side of the container opposite the first handle. Further, the handle is advantageously a strap having a flat strip having a width. The opening preferably comprises a V-shaped opening with the closed end of the V being formed in a side of the container, and wherein an open end of the V-shaped opening is smaller than the width of the strap. Preferably the container has four quadrilateral panels joined to form a quadrilateral container, with the handles connected to frames on opposing sides of the container, at top sides of the panels.

In a further variation of this invention, a gripping member is interposed between the frame and the handle, with the opening being wide enough to allow a person's hand to enter the opening to lift the container when the container is used to carry things. In this variation, the strap could be omitted. In this variation, a gripping member can be placed over each of the frames within the openings, to allow easier gripping and holding of the frame and container. Advantageously, the gripping member is sized so it does not fit within the pocket forming the opening.

Other objects and features of the invention will be come apparent from consideration of the following description taken in connection with the accompanying drawings, in which like numbers refer to like parts throughout.

DETAILED DESCRIPTION

Figure 1:
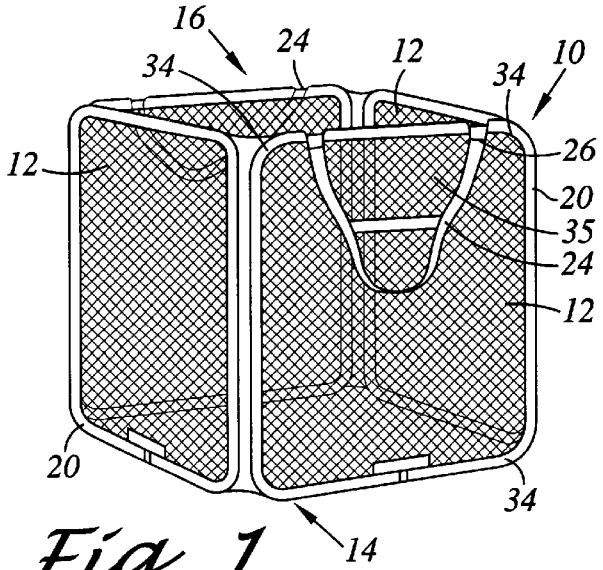
FIG. 1 shows a perspective view of a container with a handle of this invention.

Referring to FIG. 1, a collapsible container 10 is shown having four rectangular side panels 12 arranged to form a rectangular enclosure. A bottom 14 is fastened to the side panels. The portion of the container opposite the bottom 14 may be entirely open, but preferably is at least partially enclosed by a top 16 that advantageously, but optionally, contains an opening 18 through which items can be readily inserted or removed from the top of the container 10. A pocket 20 extends around the periphery of each side panel 12, and inside the pocket is a frame member 22. The frame member 22 may be arranged in various configurations, depending on the design of the particular container 10. But the frame 22 will always have a portion at the top of the container, and the frame member is typically contained entirely, or predominantly in a pocket in order to form the container.

At least one handle 24 is connected to one of the frame members 22. The handle 24 has distal ends 26*a, b*. At least one end 26 of the handle 24 encircles one of the frame members 22. An opening 28 in the pocket 20 allows the end 26 to pass through the opening 28 and encircle the frame 22. Advantageously the distal end 26 is fastened to the handle 24 after encircling the frame 22, although the ends 26*a*, 26*b* could be joined together to form a continuous loop. Sewing, riveting, gluing, or other fastening mechanisms can be used to fasten the end 26 after it encircles the frame 22. This allows a connection of the handle 24 without sewing it to the material forming the side 12 or top 16. Advantageously, the edge of the opening 28 is preferably strengthened, by forming an eyelet of fabric or metal around the opening. A strip of fabric sewn around the opening can be used.

Figure 2:
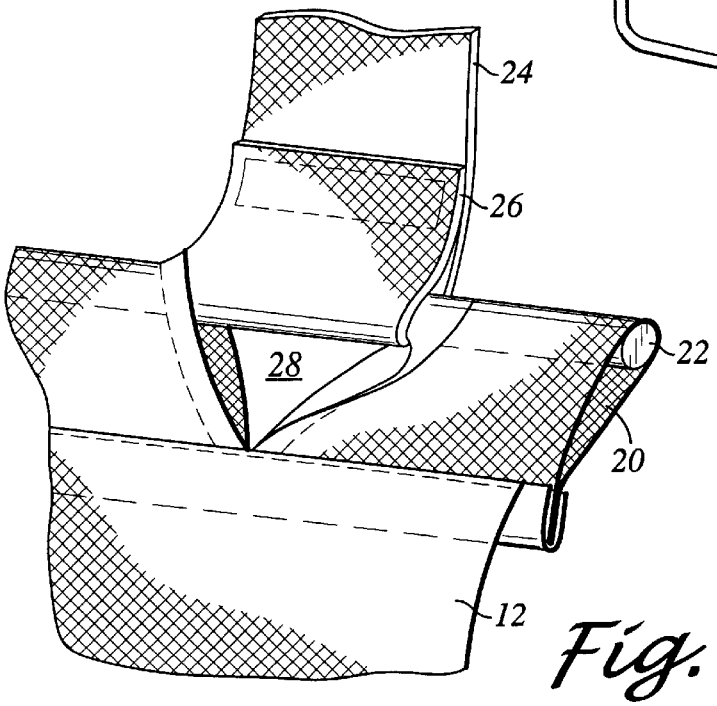
FIG. 2 shows an enlarged perspective view of the handle of FIG. 1.

Advantageously, as shown in FIG. 2, the fabric forming the pocket 20 ends on one side of the opening 28, and the distal edge 32 is folded back on itself and sewn to the major portion of the pocket to form a double thickness of fabric along one side of the opening 18. A similar construction is used on the other side of the opening 18. Thus, advantageously the pocket 20 is interrupted so the pocket does not form a continuous opening around the frame. The lower portion of the distal edges 32 on opposing sides of the opening 18 are advantageously connected. They can be sewn, rivited, glued, or fastened by other mechanisms. The lower, joined portion of the edges of the pocket 20 are advantageously joined by an overlapping hem located on the inside of the container 10 so that it is not readily seen from the outside of the container.

The joined portion is preferably located on the inside of the frame 22. This forms a "V" shaped separation in the pocket 20, with the pocket joined at the bottom and open at the top to form the "V" shape. The wide portion of the "V" is of sufficient size to accommodate the width of the handle 24. Advantageously, the wide portion of the "V" is the same size as, or slightly smaller than the width of the handle 24 so that the pocket 20 provides support immediately adjacent the handle 24.

A complete separation in the pocket 20 could be used, and a hole through the pocket, interior of frame 22 could be used. But the V-shaped notch is believed preferable. The V notch construction also avoids having the strap encircle the material forming the pocket. That reduces the forces that pull on the material forming the panels 12 and top 16 (when the top is present) and that avoids wear and tearing of that material. The connection directly to the frame 22 allows the lifting loads from the handle(s) 24 to be transferred directly to the frame 22. The frame 22 will bear against the pocket 20 to more evenly distribute the lifting force from the handles to the frame 22 and through the remainder of the container 10.

The handle 24 preferably comprises a flat strap of material that is sized so the top portion of the opening 28 can spread apart on the frame 22 a distance sufficient to accommodate the strap, but so that the edges of the opening 18 preferably slide part-way up the abutting sides of the strap. That helps conceal the frame 22 from view to make the connection more visually appealing. A flat strap also helps distribute the load over the frame 22. The shape of the edges of the pocket defining the opening 28 in the pocket 20, so that the edges of the pocket 20 overlap the handle 24, help transfer the load from the handle to the frame 22 and immediately to the pocket 20 and from there throughout the panels 12. That provides for an efficient load transfer that is sufficiently durable so that it does not tear the material forming the sides 12 of the container 12.

The handle 24 is preferably located on a portion of the frame 22 that will be horizontal when the container 10 is in its normal use, as that helps avoid the strap/handle 24 from sliding along the frame 22. Handles 24 that have a thickness much less than their width are thus preferred. A nylon strap about 1 inch wide, and about 1/16 (0.0625) inches thick, used with a pocket about 5/8 (0.675) 5 inches wide, is believed suitable.

The handles 24 can encircle the frame 22 at various locations, preferably on the top side of the frame. The opposing ends of the handles 24 preferably join the frame 22 at spaced apart distances. For frames 22 used to form flat panels or sides 12, the distal ends of handles 24 preferably join the frame adjacent opposing comers 34 of the frame. Because the frame 22 is made of twist-and-fold flexible hoops, the corners are usually curved to varying degrees. But joining the handles adjacent the opposing corners 34 of the either the same panel 12 or adjacent panels 12, allows a more stable lifting force to be applied to the container 10. Other locations can be selected as desired.

Figure 3:
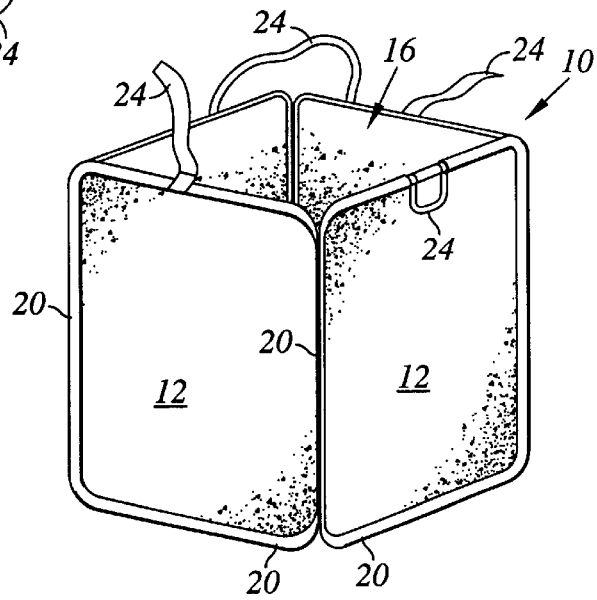
FIG. 3 shows a perspective view of a container with alternative handles.

Only one handle 24 can be used, joined at only one end of the handle as shown in FIG. 3. Advantageously, the handle 24 has both opposing ends joined to the frame 22 on the same panel 12 as that provides a more stable handle with which to lift the container 10. Further, there are preferably two handles. The handle 24 with opposing ends encircling different portions of the frame can comprise a single strap, or a webbing 35 can be placed between the opposing sides of the strap. The two handles 24 can be joined on opposing frames 10, or opposing sides of the same frame 10, as shown in FIG. 1. Alternatively, each opposing end 26*a*, 26*b*, can be joined to a different frame 22 on a different panel as shown in FIG. 3.

The sides 12 of the container are preferably covered with material. Depending on the use of the container the material can be solid fabric, mesh fabric, a polymer based material such as plastic, or other flexible materials that allow the folding of the container from an expanded configuration to a folded, collapsed configuration. The sides 12 can form flat panels, with three or more panels joined to form a container. The sides 12 can be joined together directly by using a common pocket 20, or by sewing adjacent pockets 20 together, or by placing a spacing strip intermediate the adjacent pockets 20 along the vertical sides of the panels 12. The bottom 14 is advantageously configured to provide a continuous juncture with the sides 12 and will vary depending on how adjacent sides 12 are joined. The handle 24 of this invention can also be used with single panels 12 or even with two joined panels.

Figure 4:
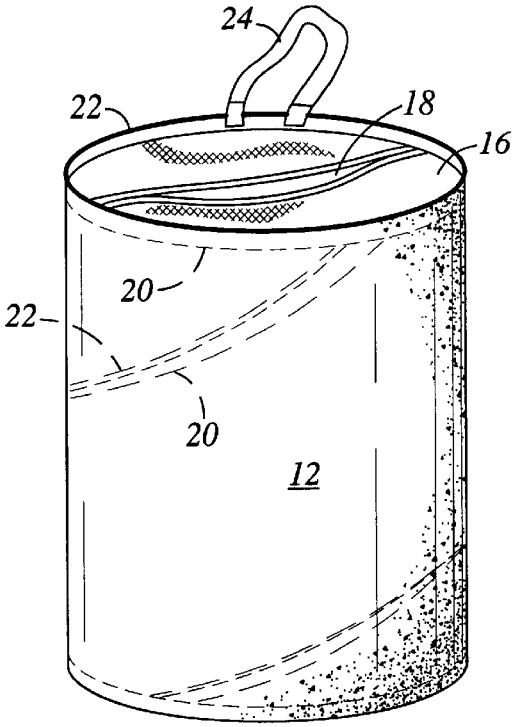
FIG. 4 shows a perspective view of a container with curved sides and a handle of this invention.
Figure 6:
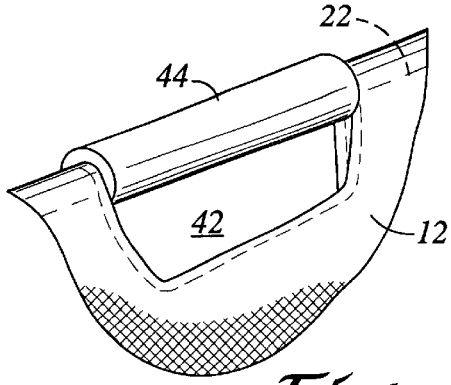
FIG. 6 shows a perspective view of an alternative handle of this invention.

Alternatively, the sides 12 can form a curved container 10 as shown in FIG. 4. The bottom 14 advantageously is formed of the same material as the sides 12 and is joined to each of the sides 12 forming the container, at the lower end of the sides. Because the bottom 14 carries the weight of the contents and transfers that weight to the frame 22 and sides 12, the bottom may be made of more sturdy and durable material, or made of increased thickness in order to accommodate the increased weight.

The top 16 could be omitted, leaving the container 10 with side panels 12 and bottom 14. Preferably though, a top 16 is provided that is joined to each of the side panels 12, at the top or vertically upper portion of the sides. The opening 18 is preferably placed in the top 16, although the top could be closed and the opening placed in one of the sides 12. The nature of the opening will vary according to the use of the container, and could comprise a slit opened by releasable fasteners such as zippers, hook and loop, or snaps. The opening 18 could be an oval, a circle, rectangle, or shaped to conform to the periphery of the top 16 but smaller to form a perpetual opening. Advantageously the container 10 has four quadrilateral panels 12, sized to form a hamper for clothing, with an opening 18 comprising a smaller circle. Panels 12 about one foot wide and two feet high, with mesh material on the panels, are believed suitable for the hamper application. But the handles 24 can be applied to a variety of containers using the twist-and-fold frames 22.

Advantageously, a cord 36 passes through one of the openings 18 to encircle one of the frames 22. The cord 36 connects a cover 38 to the container 10. The cover 38 advantageously comprises a generally rectangular form sized to receive and hold the collapsed container 10. The cover 38 advantageously has a flap 40 releasably connectable to the cover 38 to open and close the cover. A snap, loop and hook fastener, tape, or other fastening mechanisms can be used to releasably connect the flap 40 to the cover. Preferably, a clear plastic cover is used, with the cord passing through holes formed in one comer of the cover 38.

In a still further variation of this invention, an opening 42 is provided in the pocket 20 and panels 12 around the frame 22 of sufficient size so that a person's hand can grip around the frame 22 to lift the container 10. The length of the opening 42 should not be much longer than the width of a user's hand because the frame 22 transfers load to the pocket 20 and a long, unsupported portion of the frame 22 can lead to breakage of the frame at the handle location.

It is preferable, but not required, to place a gripping member 44 over the portion of the frame 22 extending across the opening 42. Advantageously, the outer periphery of the grip 44 is sufficiently large so that it does not fit inside the pocket 20 on opposing ends of the trip 42. A tubular, elastomer or plastic can be used, with the frame 22 extending through the center of the tube as the frame is inserted through the pocket 20. Alternatively, the tubular grip 42 could be slit along its length and the frame 22 inserted through the slit. Further, as with the V-shaped opening 18, the edges of the pocket 20 advantageously abut or are pressed against the grip 44. This provides for efficient transfer of the loads from the grip 44 and frame 22 to the adjacent pocket 20 and associated panels 12. As shown in the figures, the edges of the opening 42 are preferably strengthened, as for example by a hem or by folding over the material, forming the panel 12 and stitching or gluing it to strengthen the edges of the panel defining the opening 42. Further, when the frame 22 is being grabbed by hand, it may be necessary to use a heavier frame or a stronger material in order to avoid breaking the frame during lifting and carrying by hand.

The handle 24 is preferably fastened after the frame 22 is inserted in to the pocket 20. The material forming the sides 12 can have openings 28, 42 preformed in the material which is then folded to form pockets 20, or the material forming the sides can have the openings 18 cut into the pockets before the frame 22 is inserted into the pockets 20, or less desirably, the openings 28, 42 can be formed after the pockets 20 are formed and the frame 22 inserted is into the pockets. A distal end 26 is inserted into one of the openings 28, 42, wrapped around the frame 22 and fastened to itself to form the handle 24. The process is repeated for the opposing end of the handle 24. The handle 24 can be cut to predetermined lengths, or it can be formed from a continuous strip of material that is cut to length after the first end of the handle is attached.

Figure 8:
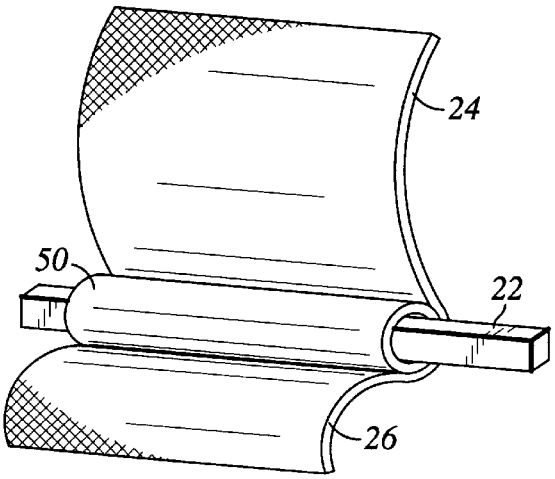
FIG. 8 shows a perspective view of a further embodiment showing a protective sheath interposed between a frame and a handle.
Figure 9:
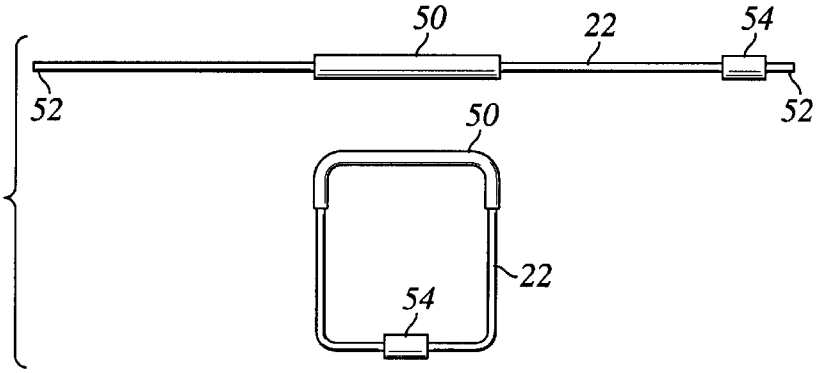
FIG. 9 shows a plan view of the assembly of a frame using an alternative embodiment of the sheath of FIG. 8.
Figure 10:
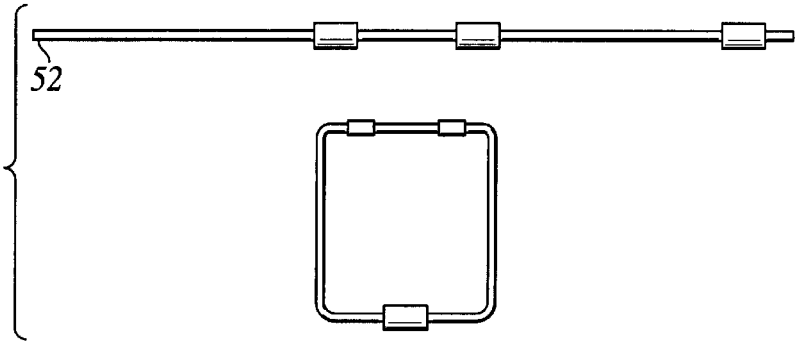
FIG. 10 shows a plan view of the assembly of a frame using the sheath of FIG. 8.

Referring to FIGS. 8–10, a further embodiment is shown which interposes a protective sheath 50, such as a plastic tube, between the frame 22 and the handle 24. For ease of illustration the fabric or flexible material forming the sides and pockets are not shown in these Figures, and in FIG. 8 the distal end 26 is not yet fastened to the strap 24 to complete the construction of the handle. The frame 22 can have various cross-sectional shapes. If the frame 22 has a cross-sectional shape with corners, such as a square or rectangular shape, then the corners can cut into the handle 24. Even if the frame 22 has rounded corners as with an oval or circular cross-section, a small radius of curvature can abrade the handle 24 over time. Thus, a protective sheath 50 is interposed between the frame 22 and the handle 24 to avoid abrasion.

The sheath 50 can comprise a plastic tube, advantageously made of polypropylene or polyvinylchloride (PVC) that is slid over the frame 24 when the frame is straight. The sheath is preferably slid into a position that corresponds to the location of the handles 24 when the frame is inserted into the pockets 20 and formed into a rectangular, circular or other shape as defined by the pocket 20 around the sides 12 of the container 10. When the frame 22 is inserted into the pockets 20 and then placed into its final configuration, the location of the sheath(s) 50 correspond to the location of openings 18 and the handle 24. The sheath 50 can be sized to be only slightly larger than the frame 22 so that frictional engagement between the sheath 50 and frame helps restrain relative movement between the frame and sheath. The thickness of the walls on the sheath 50 can be varied as desired. But the wall thickness is preferably small in order to reduce costs. A metal or plastic frame 22 could be continuously coated with a thin but durable layer of plastic in order to form a continuous sheath 50. But preferably the sheath 50 does not extend for the entire length of the frame 22 in each side 12. The sheath 50 is preferably a tube inserted over the frame 22. The sheath 50 is preferably a tube with a circular cross-section, but could be of other cross-sectional shapes, including, but not limited to, square or rectangular shapes. The internal dimension of the sheath 50 should be large enough so that the sheath can be slid over the frame. Preferably the internal dimension is small enough so that the sheath does not slide easily over the frame 22 once the sheath is in its desired position. Advantageously, the sheath 50 is held or fastened in position to guard against movement. The sheath 50 could be fastened in position by adhesive placed intermittently or continuously along the length of the sheath, or placed at one or more ends of the sheath 50. The sheath 50 could be fastened in position by tape placed at one or both ends of the sheath. Alternatively, sheath 50 could be held in position by friction if the sheath extends over a non-straight, contoured portion of the frame 22 as shown in FIG. 9 where the sheath extends around a curved corner of the side. Combinations of these can also be used.

As shown in FIG. 10, the sheath 50 can comprise short segments located at the openings 18 and handles 24. In such cases, the sheath 50 could be slightly shorter than the width of the handle 24 so that the edges of the preferably flexible handle material fold over the distal ends of the sheath 50 to conceal the sheath 50. But the sheath 50 can be longer than the opening 18 and the strap or handle 24 so that the handle 24 can slide along the length of the frame 22 and still be protected by the sheath 50.

Alternatively, as shown in FIG. 9, the sheath 50 can extend for the length of the segment of the frame 22 on which the handle(s) 24 are placed. This requires more material, but allows movement of the handle 24 along the length of the frame 22. In this embodiment the sheath 50 advantageously extends for the length of the top portion of the frame 22 to which the handle 24 attaches. Advantageously, the sheath 50 extends around the curved corners of the frame. Moreover, the sheath 50 is preferably inserted over the frame 24 when the frame is straight, so that when the frame is bent to form a loop the sheath extends over a curved corner of the frame, that curvature causes sufficient frictional engagement between the frame 22 and sheath 50 to help prevent movement of the sheath 50 relative to the frame 22. Adhesives or tape could still be used to further guard against movement of the sheath 50 relative to the frame 22 and handle 24.

Figure 11:
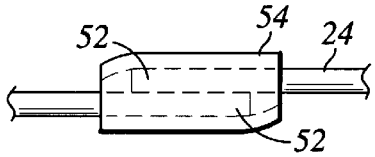
FIG. 11 shows a plan view of a portion of FIG. 9 showing joined ends of the frame.

Referring to FIG. 11, when the straight segments of the frame 22 are inserted into the respective pockets 20, the distal ends 52 of the frame 22 are connected to form a loop. The ends 52 are usually joined by overlapping the ends 52 and fastening them together. The ends 52 can be spot welded or crimped together or a deformable metal sheath can be placed over the overlapping ends and the sheath crimped to the overlapping ends. Advantageously, a protective sheath 54 is also placed over these joined ends 52. The sheath 54 is like sheath 52 but slightly larger in order to fit over two ends 52. The sheath 54 is can be placed over the frame 22 adjacent one of the distal ends 52 and then slid into position after the frame 22 is inserted into the pocket 20. Alternatively, the sheath 54 can be slid over one of the ends 52 after the frame 22 is inserted into the pocket 20. After the ends 52 are joined, the sheath 54 is slid over the joined ends 52. A small opening in the pocket 20 on the side corresponding to the interior of the container is formed to allow access to join the ends 52 and to allow placement of the sheath 54. The sheath 54 is preferably long enough to extend over the overlapping distal ends 54 and if so, friction can hold the sheath 54 in position as the walls of the tubular sheath 54 are flexible enough to deform around the opposing ends 52 of the frame 22 and resist movement of the sheath relative to the ends 52. Adhesive or tape can also be used to further guard against movement of the sheath 54.

FIGS. 9 and 10 illustrate the preferably placement of the sheath(s) 50 onto the frame 22 when the frame is straight, before it is inserted into the pockets 20. It is possible, but not preferable, to slit a tubular sheath 50 along its length and slip the sheath over the frame through that slit.

There is thus advantageously provided a method for producing a collapsible container 10 having handles 24 directly connected to the flexible frame 22 so as to better distribute the load throughout the container.

The above description is given by way of example, and not limitation. Given the above disclosure, one skilled in the art could devise variations that are within the scope and spirit of the invention. Further, the various features of this invention can be used alone, or in varying combinations with each other and are not intended to be limited to the specific combination described herein.

Figure 7:
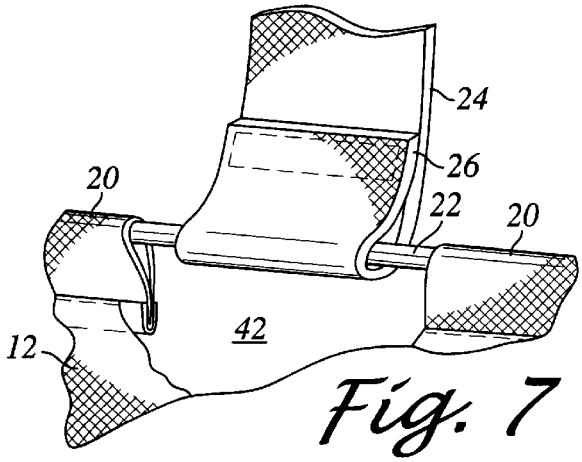
FIG. 7 shows a perspective view of a further embodiment of this invention.
Figure 5:
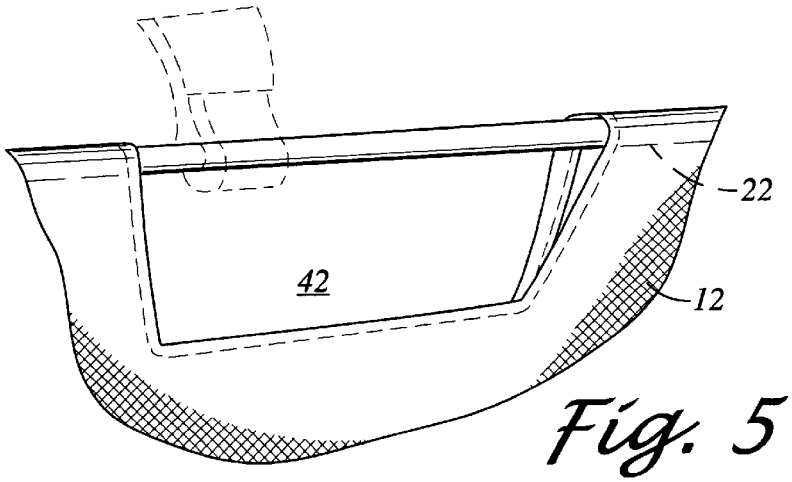
FIG. 5 shows a perspective view of an alternative handle of this invention.

Thus, for example, the handles 24 could be used with the openings 42 so a user could carry the container by grabbing the handle 24, by grabbing the frame 22, or by grabbing the grip 44. The handles 24 could thus encircle the grip 44 so the grip is interposed between the handle and the frame 22. In this configuration, the strap 22 is preferably wider than the opening 42, although it could be smaller as shown in FIGS. 5 and 7. Thus, the invention is not to be limited by the illustrated embodiments but is to be defined by the following claims when read in the broadest reasonable manner to preserve the validity of the claims.

I claim:

1. A collapsible container adapted to allow a person to manually carry items within the container by use of at least one handle connected to the container, the container having a plurality of flexible loop frames each contained in a pocket fastened to flexible material connected to form sides of the container in an expanded configuration, the container being collapsible into a smaller configuration by twisting and folding the frames into overlapping coils into the smaller configuration, the handle comprising a flexible handle suitable for manually lifting the container and having a first end extending into and out of a first opening in one of the pockets and encircling a portion of one of the flexible frames within that first opening, the first end being connected to the flexible handle.

2. The container of claim 1, wherein the handle has a second end extending through a second opening in the pocket and encircling a portion of said one of the frames within that second opening, the second end being connected to the handle.

3. The container of claim 2, further comprising a second handle located on a portion of the container opposite the first handle, the second handle having third and fourth opposing ends each extending through different openings in a second pocket associated with a second frame to connect to a portion of the second frame forming the container.

4. The container of claim 2, wherein the handle comprises a flat strap having a width.

5. The container of claim 4, wherein the opening comprises a V-shaped opening with the closed end of the V being formed in a side of the container, and wherein an open end of the V-shaped opening is smaller than the width of the strap.

6. The container of claim 1, further comprising a protective sheath interposed between the handle and the frame.

7. A collapsible container adapted to allow a person to manually carry items in the container by the use of at least one handle, the container comprising at least a fist and second flexible loop frames each contained in a pocket with material connecting the pockets and covering each loop frame to define panels when the frames are ill an expanded configuration, the frames being adapted to twist and fold into overlapping coils to define a smaller, collapsed configuration, the pocket containing the first frame having a first opening amass which the first flexible frame extends, the at least one handle having a first end extending into and out of the first opening and fastening to itself after encircling the portion of the first flexible frame extending across the first opening within that first opening to connect the handle to the first frame, the connection being located, and the handle being sized, to allow the handle to be used to lift the container.

8. The collapsible container of claim 7, wherein a second end of the handle extends through a second opening in a pocket containing the first frame to encircle a portion of the first frame within the second opening.

9. The collapsible container of claim 8, wherein a second end of the handle extends through a second opening in a pocket containing the first frame to encircle a portion of the first frame within the second opening, and further comprising a second handle having opposing ends extending through openings in pockets containing a second frame to encircle the second frame.

10. The collapsible container of claim 9, wherein the each opening in the container is smaller than a width of the handle encircling the frame within the respective openings.

11. The collapsible container of claim 9, wherein the container has four quadrilateral panels joined to form a quadrilateral container, with the handles connected to frames on opposing sides of the container, at top sides of the panels.

12. The collapsible container of claim 7, wherein the opening in the container is smaller than a width of the handle encircling the frame within each respective opening.

13. A collapsible container, comprising:

a plurality of adjacent side panels, each side panel having a bottom side, a top side and two lateral sides, each of said side panels further including a web having a perimeter and a peripheral pocket of flexible material attached to substantially the entire perimeter of the web, each of the lateral sides of each side panel being attached to the lateral side of an adjacent side panel to form the container;

a plurality of flexible, continuous loop frames each of which can be coiled and folded into three overlapping loops, each frame being contained within one of the pockets, the pockets including a first pocket having a first opening with the flexible frame contained within that first pocket extending across that first opening;

a floor panel having a plurality of sides, each of the floor panel sides being attached to at least one of the bottom sides of the side panels; and a first flexible strap having a first end that passes into and out of the first opening while also looping around the flexible frame extending across the first opening, the first end being fastened to the first flexible strap.

14. The collapsible container of claim 13, further comprising a protective sheath encircling the flexible frame within the first opening and interposed between the first strap and the flexible frame extending across the first opening.

15. The collapsible container of claim 13, wherein the first opening has a width smaller than a width of the first strap as it passes through the opening.

16. The collapsible container of claim 13, wherein the pockets include a second pocket having a second opening with the flexible frame that is contained within that second pocket extending across that second opening, and wherein the first flexible strap further includes a second end that enters the second opening, encircles the frame extending across the second opening and leaves the second opening.

17. The collapsible container of claim 16, wherein the first and second openings are on the same frame.

18. The collapsible container of claim 16, wherein the first and second openings are on different frames.

19. The collapsible container of claim 16, further comprising a first protective sheath encircling the flexible frame extending across the first opening and interposed between the first strap and the flexible frame extending across the first opening, and a second protective sheath encircling the flexible frame extending across the second opening and interposed between the first strap and the flexible frame extending across the second opening.

20. The collapsible container of claim 19, where each protective sheath has a length that is larger than a length of the opening within which the sheath is located.

21. The collapsible container of claim 14, where the protective sheath has a length that is larger than a length of the first opening.

22. The collapsible container of claim 13, wherein the opening is V shaped and has a largest width that is smaller than a width of the first end passing through the opening.

23. The collapsible container of claim 13, wherein the opening has a rectangular shape.

24. A collapsible container, comprising:

a plurality of adjacent panels, each side panel having a web having a perimeter and a peripheral pocket attached to substantially the entire perimeter of the web, each of the sides of each side panel being attached to an adjacent side panel to form the container;

a plurality of flexible, continuous loop frames each of which can be coiled and folded into overlapping loops, each frame being contained within one of the pockets, the pockets including a first pocket having a first opening with the flexible frame contained within that first pocket extending across that first opening; and a first flexible strap having a first end that passes into and out of the first opening while also looping around the flexible frame extending across the first opening, the first end being fastened to the first flexible strap.

25. The collapsible container of claim 24, further comprising a protective sheath encircling the flexible frame within the first opening and interposed between the first strap and the flexible frame extending across the first opening.

26. The collapsible container of claim 24, wherein the first opening has a width smaller than a width of the first strap as it passes through the opening.

27. The collapsible container of claim 24, wherein the first opening has a rectangular shape.

28. A collapsible container adapted to allow a person to manually carry items within the container by use of at least one handle connected to the container, the container having a plurality of flexible loop frames each contained in a pocket fastened to flexible material connected to form sides of the container in an expanded configuration, the container being collapsible into a smaller configuration by twisting and folding the frames into overlapping loops into the smaller configuration, the handle comprising a flexible handle suitable for manually lifting the container and having a first end extending through an opening in one of the pockets and encircling a portion of one of the flexible frames within that opening, the first end being connected to the flexible handle, the flexible handle comprises a flat strap wherein the opening comprises a V-shaped opening in which the open end of the V-shaped opening is smaller than a width of the strap extending through that open end of the V-shaped opening.

29. A collapsible container adapted to allow a person to manually carry items in the container by the use of at least one handle, the container comprising at least a first and second flexible loop frames each contained in a pocket with material connecting the pockets and covering each loop frame to define panels when the frames are in all expanded configuration, the frames being adapted to twist and fold into overlapping loops to define a smaller, collapsed configuration, the pocket containing the first frame having a first opening across which the first flexible frame extends, the at least one handle having a first end encircling the portion of the first flexible frame extending across the first opening within that first opening to connect the handle to the first frame, the connection being located, and the handle being sized, to allow the handle to be used to lift the container, wherein the first opening in the container is smaller than a width of the handle encircling the frame within that first opening.

30. The collapsible container of claim 29, wherein the pockets include a second pocket having a second opening with the flexible fine that is contained within that second pocket extending across that second opening, and wherein the first flexible strap further includes a second end that is connected directly to the flexible frame that it extends across the second opening.

31. The collapsible container of claim 30, wherein the same flexible frame extends across the first and second openings to be directly connected to the first strap.

32. The collapsible container of claim 30, wherein the first and second openings are on different frames.

* * * * *